United States Patent [19]

Smadja et al.

[11] 3,977,912

[45] Aug. 31, 1976

[54] PROCESS FOR REDUCING THE RATE OF SLUDGE FORMATION IN CRYSTALLINE PHOSPHATIZING BATHS

[75] Inventors: Dora Smadja, Paris; Marie-Therese Decker, Gennevilliers; Francoise Derouet, Levallois-Perret; Guy Lorin, Enghiens-les-Bains, all of France

[73] Assignee: Oxy Metal Industries Corporation, Warren, Mich.

[22] Filed: Apr. 21, 1975

[21] Appl. No.: 569,733

[30] Foreign Application Priority Data

Apr. 22, 1974 France ..... 74.13920

[52] U.S. Cl. ..... 148/6.15 R; 148/6.15 Z

[51] Int. Cl.[2] ..... C23F 7/10

[58] Field of Search ..... 148/6.15 R, 6.15 Z

[56] References Cited

UNITED STATES PATENTS

| | | | |
|---|---|---|---|
| 2,304,299 | 12/1942 | Boyle et al. | 148/6.15 Z |
| 2,744,555 | 5/1956 | Nicholson et al. | 148/6.15 R |
| 3,276,916 | 10/1966 | Wurstner | 148/6.16 |

*Primary Examiner*—Ralph S. Kendall

*Attorney, Agent, or Firm*—Arthur E. Kluegel; Richard P. Mueller; Bertram F. Claeboe

[57] ABSTRACT

Disclosed is a process for reducing the rate of sludge formation in a crystalline phosphatizing process. The phosphatizing bath includes 0.005 to 20 g/l of a phosphoric acid ester of an organic condensation product containing an alkylene oxide chain.

3 Claims, No Drawings

PROCESS FOR REDUCING THE RATE OF SLUDGE FORMATION IN CRYSTALLINE PHOSPHATIZING BATHS

BACKGROUND OF THE INVENTION

This invention concerns aqueous solutions for forming crystalline phosphate coatings on metal surfaces. Conventional techniques for forming crystalline phosphate coatings are described in the following publications and references cited therein, the contents of which are incorporated herein by reference:

METALS HANDBOOK, 8th Ed. Vol. 2 ASM (1964) Pgs. 531–547;

ENCYCLOPEDIA OF CHEMICAL TECHNOLOGY, 2nd Ed. V. 13 John Wiley & Sons, Inc. (1967) Pgs. 293–297;

SURFACE PREPARATION AND FINISHES FOR METALS McGraw-Hill Book Co. (1971) Pgs. 396–401.

These techniques are generally based upon the formation of crystalline coatings containing insoluble zinc or manganese phosphate. The dihydrogen phosphates of these metals are soluble under bath conditions. During processing, however, the monohydrogen phosphate salt is formed which contributes to sludge formation to a substantial extent.

One of the crucial problems relative to the process of crystalline phosphatization lies in the accumulation of this insoluble sludge which settles either on the bottom of the tank containing the phosphatizing solution or on the heating elements. The accumulation on the heating elements lowers the heat exchange efficiency and creates problems in regard to maintaining the temperature of the bath. The settling of sludge on the bottom of the tank reduces the necessary amount of clear phosphatizing liquid making it difficult to obtain the desired coatings and results in consumption of active chemicals. Some sludge may settle on the metal surface causing the formation of a nonadherent "dusting", which lowers the quality of the surface coating.

If left unchecked, the sludge buildup will eventually necessitate dumping the treating solution and cleaning the tank. This procedure is costly and time consuming, and is therefore preferably performed as infrequently as possible. Physical means such as filtration or decanting have been employed to lengthen the useful life of baths but these techniques create new problems and do not avoid all of the above-mentioned sludge problems.

The purpose of this invention is to reduce the disadvantages of sludge formation by providing a way of reducing the rate of formation of sludge during the phosphatization treatment. U.S. Pat. Nos. 2,304,299; 2,744,555 and 2,804,498 refer to the inclusion of phosphate esters in phosphatizing baths but do not suggest that the particular esters employed in the present invention will reduce the rate of sludge content in a crystalline phosphatizing bath.

SUMMARY OF THE INVENTION

According to the process of the invention, the rate of scale formation in a crystalline phosphatizing bath may be reduced by including from 0.005 to 20 g/l of a certain phosphate ester therein. Suitable esters are those wherein at least one hydrogen of phosphoric acid is replaced by an organic condensate radical of the formula $$+ R''O )_n R'$$

wherein $R''$ = alkyl groups of 2 to 3 carbon atoms;

$R'$ = alkyl, oxoalkyl or alkylphenol group where the alkyl group has 5 to 20 carbon atoms;

$n$ = an integer from 3 to 15.

In other words, the phosphoric esters usable in the process of the invention can be represented by the following formulas:

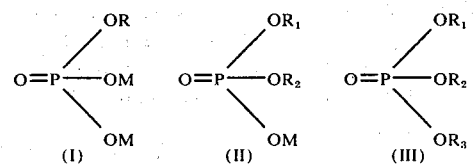

wherein R, $R_1$, $R_2$, and $R_3$ represent alkyl or alkylaryl radicals modified by the addition of 3 to 15 moles of alkylene oxide, and M represents hydrogen, a metallic cation (such as sodium and potassium, for example) or ammonium.

Thus, the alcohols or alkyl phenols have been modified, before esterification, by fixation on their alkylic chain of molecules of an alkylene oxide, preferably of ethylene oxide or propylene oxide.

DETAILED DESCRIPTION OF THE INVENTION

It is possible to use an ester of either formula I, II, or III by itself or a mixture of several of these esters. Mono- and di-esters and their mixtures are favored for reasons of availability. Examples of phosphoric esters usable in the present invention are ethoxylated nonylphenol or octylphenol esters containing from 3 to 15 moles of ethylene oxide, available frequently in the form of mono- and di-ester mixtures and commercially known under the brands: Gafac RE 610 (General Aniline and Film Corp), Celanol P S 17 (Rhone-Progil), Emcol C S 141 (Witco Chemical), etc. Examples of other phosphoric esters that can be used, include those derived from ethoxylated tridecylic alcohol to be found under the trade names: Celanol P A 21 (Rhone-Progil), Beycostat 319 A (Societe Chimique de Gerland), and Phosphac DION (Societe PROTEX).

Another suitable ester is a mono- and di-ester mixture from an oxo-alcohol of an 11–13 carbon atom alkyl group bearing six ethylene oxide groupings.

The process of the invention is especially applicable to "crystalline" phosphatizing solutions which contain zinc or manganese and possibly modifying ions such as calcium, nickel, or cobalt which are used to produce a protective coating over metals such as zinc, aluminum, steel or iron.

When the phosphoric acid esters are added to these baths, the result is a substantial reduction in the rate of sludge formation, apparently caused by the influence of the ester on the structure of the nonsoluble products. The esters are stable in the medium under consideration and do not affect the working of the bath. The improvement of the bath is evident over the whole range of temperatures, functioning from 20° to 100°C.

Typical phosphatizing solutions in which this invention can be put to use are the following:

| Ions | Range of concentration g/liter |
|---|---|
| Calcium$^{2+}$ | 0 to 100 |
| Manganese$^{2+}$ | 0 to 100* |
| Zinc$^{2+}$ | 0 to 50* |
| Sodium$^{2+}$ | 0 to 50 |
| Iron$^{2+}$ | 0 to 10 |
| Phosphate$^{3-}$ | 1 to 100 |
| Nitrate$^{-}$ | 0 to 250 |

*At least 0.1 g/l of Zn or Mn required.

Typical pretreatment procedures include degreasing, cleaning, or pickling with intermediary rinsings.

This invention is particularly useful in the case of treatment by immersion either for the purpose of corrosion protection or as a pretreatment prior to cold forming operations.

The concentrations given above for the composition of the phosphatization solutions will vary according to the final application. For example, the coatings used as primer for paint have to be lighter than those used as a base for a lubricant.

In addition, it is possible to utilize various ions which modify the coatings, or accelerate their rate of formation; for example, nitrite (0.005–0.1%), fluoride (0.01–0.5%), chlorate (0.05–2%), and nickel (0.001–0.4%). All of these percentages are expressed in weight.

This effective quantity of the ester is generally between 0.005 g and 20 g of ester or mixture of esters per liter of solution, the preferred range being between 0.02 and 5 g/liter. These quantities are calculated in terms of phosphoric ester at 100%.

The phosphoric ester can be added either directly into the phosphatization solution or into the concentrated product used to form this solution.

The following examples are given as illustrations of the invention.

EXAMPLE 1

Bundles of decarbonized bare steel wires were treated after having been degreased in an alkaline solution, then pickled in a sulfuric medium. The wires were then immersed in a solution containing:

| | |
|---|---|
| Zn | 19.8 g/liter |
| Ni | 0.2 g/liter |
| Co | 0.03 g/liter |
| $PO_4$ | 14.5 g/liter |
| $NO_3$ | 34.4 g/liter |

at a temperature of 70°C for 10 minutes. Just prior to the treatment, a quantity of 0.2 g/liter sodium nitrite was added.

After the treatment of an area of 1 m$^2$/liter, the amount of decanted sludge was 285 m$^1$/liter.

The operation is performed again with the phosphatizing solution additionally containing 0.2 g/liter of a phosphoric ester from an ethoxylated alcohol of $C_8$–$C_{10}$ with mol ethylene oxide. After treating 1 m$^2$/liter of surface, the amount of sludge is only 150 m$^1$/liter.

The addition of phosphoric ester has therefore brought about a decrease in the amount of sludge of nearly 50%. Industrially, this decrease is important because the tanks need be cleaned only half as frequently, thereby saving manpower and time.

EXAMPLE 2

A phosphatizing composition was used, as indicated below:

| | |
|---|---|
| Zn | 14.7 g/liter |
| Ni | 0.05 g/liter |
| Ca | 0.25 g/liter |
| $PO_4$ | 11.5 g/liter |
| $NO_3$ | 30.8 g/liter |

After degreasing, pieces of cold-rolled steel were immersed in this solution at 70°C for 10 minutes. Before treatment, 0.2 g/liter of sodium nitrite was added to the solution. After 1 m$^2$/liter of area was treated, the volume of the sludge was 160 m$^1$liter.

When the experiment was performed again, but with the addition of 0.3 g/liter of a phosphoric ester of ethoxylated nonylphenol with 6 mol of ethylene oxide, the amount of the sludge was only 40 m$^1$/liter. In this case, the decrease of the volume of sludge is on the order of 75%.

EXAMPLE 3

The conditions of Example 2 are duplicated but Celanol P S 17 by Rhone-Progil was employed as the phosphoric ester. After 1 m$^2$/liter of area had been treated, the sludge amounted to 45 ml/liter.

EXAMPLE 4

The conditions of EXAMPLE 2 were duplicated except this time different phosphoric esters were used at the rate of 0.5 g/liter. The following table shows the composition of the phosphoric ester added to the treatment solution, and the amount of sludge after treatment of an area of 1 m$^2$/liter.

| Phosphoric esters | Volume of sludge in ml/liter |
|---|---|
| Phosphoric ester of ethoxylated nonylphenol with 6 moles of ethylene oxide | 40 |
| Phosphoric ester of ethoxylated laurylic alcohol with 4 moles of ethylene oxide | 72 |
| Phosphoric ester of ethoxylated tridecyclic alcohol with 8 moles of ethylene oxide | 32 |
| Phosphoric ester of a linear alcohol $C_{10}$–$C_{12}$ with 6 moles of propylene oxide | 100 |
| Phosphoric ester of ethoxylated oxotridecylic alcohol with 6 moles of ethylene oxide | 70 |
| Phosphoric ester of ethoxylated nonylphenol with 10 moles of ethylene oxide | 100 |
| Without phosphoric ester (test bath) | 160 ml/liter |

In every case, the addition of phosphoric ester according to the invention has brought forth a substantial decrease of the amount of the sludge.

EXAMPLE 5

Another experiment is prepared in which the phosphatizing solution can be described as follows:

| | |
|---|---|
| Zn | 3.8 g/liter |
| $ClO_3$ | 4.4 g/liter |
| $PO_4$ | 15 g/liter |
| Na | 1.2 g/liter |

In this solution, pieces of cold-rolled steel were immersed for 10 minutes at 70°C after degreasing. After an area of 1 $m^2$/liter was phosphatized, the volume of sludge was 60 ml/liter.

The operation was repeated, but this time the bath contained 0.3 g/liter phosphoric ester of an ethoxylated oxo-alcohol at $C_{11}$–$C_{13}$ with 6 moles of ethylene oxide. After treating an area 1 $m^2$/liter, the volume of the sludge was only 20 ml/liter.

What is claimed is:

1. In a process for forming a crystalline zinc or manganese-based phosphate coating on a metallic surface wherein the surface is contacted with an aqueous acidic solution containing a zinc or manganese phosphate compound, and wherein insoluble sludge is formed during the contact period, the improvement comprising reducing the rate at which sludge is formed by including in the solution 0.005 to 20 g/liter of a phosphoric acid ester in which at least one hydrogen is replaced by an organic condensate radical of the formula:

$$+ R''O )_n R'$$

wherein $R''$ = alkyl group of 2 to 3 carbon atoms;

$R'$ = alkyl, oxoalkyl or alkyl phenol group where the alkyl group has 5 to 20 carbon atoms;

$n$ = an integer from 3 to 15.

2. The process of claim 1 wherein at least one of the remaining hydrogens is replaced by a soluble cation selected from the group consisting of alkali metal and ammonium.

3. The process of claim 1 wherein the ester concentration is 0.02 to 5 g/liter.

* * * * *